US009581377B2

(12) United States Patent
Kim et al.

(10) Patent No.: US 9,581,377 B2
(45) Date of Patent: Feb. 28, 2017

(54) REFRIGERATOR

(75) Inventors: Cheolhwan Kim, Changwon-si (KR); Wonyeong Jung, Changwon-si (KR); Deokhyun Youn, Changwon-si (KR); Jeongyon Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1007 days.

(21) Appl. No.: 13/581,455

(22) PCT Filed: Feb. 26, 2010

(86) PCT No.: PCT/KR2010/001258
§ 371 (c)(1),
(2), (4) Date: Aug. 27, 2012

(87) PCT Pub. No.: WO2011/105647
PCT Pub. Date: Sep. 1, 2011

(65) Prior Publication Data

US 2013/0000333 A1 Jan. 3, 2013

(30) Foreign Application Priority Data

Feb. 26, 2010 (KR) ..... 10-2010-0018024

(51) Int. Cl.
*F25D 17/06* (2006.01)

(52) U.S. Cl.
CPC .... *F25D 17/065* (2013.01); *F25D 2317/0651* (2013.01); *F25D 2317/0665* (2013.01)

(58) Field of Classification Search
CPC ..... F25D 17/065; F25D 2317/0665; F25D 2317/0651; F25D 2317/061; F25D 17/045; F25D 2317/0415
See application file for complete search history.

(56) References Cited

U.S. PATENT DOCUMENTS 5,704,224 A * 1/1998 Choi ..... 62/407
6,041,616 A 3/2000 Jeong
(Continued)

FOREIGN PATENT DOCUMENTS

CN 1206099 A 1/1999
CN 1255615 A 6/2000
(Continued)

*Primary Examiner* — Judy Swann
*Assistant Examiner* — Zachary R Anderegg
(74) *Attorney, Agent, or Firm* — Birch, Stewart, Kolasch & Birch, LLP

(57) ABSTRACT

Provided is a refrigerator. The refrigerator includes a cabinet defining a refrigerating compartment and a freezing compartment, a heat exchange chamber defined in a side of the cabinet to provide a space for receiving an evaporator, a storage compartment defined in the cabinet, the storage compartment being independent from the refrigerating compartment, the freezing compartment, and the heat exchange chamber, a supply duct assembly connecting the heat exchange chamber to the storage compartment to provide a cool air supply passage, and a guide duct communicating with the supply duct assembly, the guide duct extending from a rear surface of the storage compartment up to a front portion of the storage compartment to guide cool air into a front side of the storage compartment. The guide duct discharges the cool air from the front portion of the storage compartment toward the inside of the storage compartment.

11 Claims, 14 Drawing Sheets

(56) References Cited

U.S. PATENT DOCUMENTS

| | | | | |
|---|---|---|---|---|
| 6,055,826 | A * | 5/2000 | Hiraoka et al. | 62/408 |
| 6,094,931 | A * | 8/2000 | Jeong | 62/407 |
| 6,293,122 | B1 | 9/2001 | Chang | |
| 6,381,982 | B1 * | 5/2002 | Kim | F25D 17/065 62/407 |
| 6,539,729 | B2 * | 4/2003 | Tupis et al. | 62/89 |
| 2002/0059805 | A1 | 5/2002 | Lee et al. | |
| 2003/0097850 | A1 * | 5/2003 | Chang et al. | 62/156 |
| 2008/0156029 | A1 * | 7/2008 | Ritchie et al. | 62/408 |
| 2010/0089089 | A1 * | 4/2010 | Bischofberger | F25D 17/042 62/407 |
| 2011/0204762 | A1 * | 8/2011 | Eubanks | F25D 17/042 312/404 |

FOREIGN PATENT DOCUMENTS

| | | | |
|---|---|---|---|
| CN | 1782639 | A | 6/2006 |
| JP | 61-55687 | U | 4/1986 |
| JP | 7-43201 | B2 | 5/1995 |
| JP | 10-176880 | A | 6/1998 |
| JP | 10-253218 | A | 9/1998 |
| JP | 2002-090029 | A | 3/2002 |
| JP | 2002-174480 | A | 6/2002 |
| JP | 2003-65622 | A | 3/2003 |

* cited by examiner

REFRIGERATOR

BACKGROUND

Embodiments relate to a refrigerator.

In general, refrigerators are home appliances for storing foods at a low temperature in an inner storage space covered by a door. That is, since such a refrigerator cools the inside of a storage space using cool air generated by heat-exchanging with a refrigerant circulating a refrigeration cycle, foods stored in the storage space may be stored in an optimum state.

With the change in dietary life and well-being trends, large and multifunctional refrigerators have been introduced, and also refrigerators are being developed in various shapes for user's convenience.

In recent, a storage compartment having an independent space is defined in a cabinet of a refrigerator in addition to a refrigerating compartment and a freezing compartment. Also, refrigerators which can use the storage compartment as the refrigerating compartment or the freezing compartment by adjusting a temperature within the storage compartment through cool air supplied into the storage compartment are being released in markets. Also, the storage compartment communicates with the freezing compartment or a heat exchange chamber to receive cool air. In general, the storage compartment may have a structure in which the cool air is discharged forward from a rear surface thereof.

However, in case where the storage compartment is used as the refrigerating compartment, a flow rate of the cool air may be low. Also, in case where the storage compartment has a long length in a front and rear direction, the cool air is not moved into a front side of the storage compartment due to the insufficient flow rate of the cool air. Thus, the cool air is suctioned again and introduced into the freezing compartment or the heat exchange chamber.

Specifically, a front surface on which a door is disposed is relatively weak in view of thermal insulation in a structure of a refrigerator. Thus, the front surface of the refrigerator may be greatly influenced by an external temperature. As a result, an internal temperature of the storage compartment may be non-uniformly distributed to reduce storage performance.

SUMMARY

Embodiments provide a refrigerator in which an internal temperature of a storage compartment is uniformly distributed to improve storage performance.

In one embodiment, a refrigerator includes: a cabinet defining a refrigerating compartment and a freezing compartment; a heat exchange chamber defined in a side of the cabinet to provide a space for receiving an evaporator; a storage compartment defined in the cabinet, the storage compartment being independent from the refrigerating compartment, the freezing compartment, and the heat exchange chamber; a supply duct assembly connecting the heat exchange chamber to the storage compartment to provide a cool air supply passage; and a guide duct communicating with the supply duct assembly, the guide duct extending from a rear surface of the storage compartment up to a front portion of the storage compartment to guide cool air into a front side of the storage compartment, wherein the guide duct discharges the cool air from the front portion of the storage compartment toward the inside of the storage compartment.

A front discharge hole for discharging the cool air forward may be defined in a front end of the guide duct.

A lower discharge hole for discharge the cool air downward may be defined in a bottom surface of the guide duct.

The entire opened area of the lower discharge hole may be equal to a sectional area of the guide duct.

An inner surface of the storage compartment may be recessed in a shape corresponding to that of the guide duct.

A damper may be disposed on the supply duct assembly to convert the storage compartment into the refrigerating compartment or the freezing compartment.

The guide duct may be mounted on a top surface of the storage compartment.

The guide duct may include: an extension part communicating with the supply duct assembly, the extension part being lengthily disposed in a horizontal direction; and first and second guide parts extending forward from both ends of the extension part to guide the cool air forward, respectively.

A temperature sensor for measuring a temperature of the storage compartment may be disposed on the extension part.

A damper for blocking the introduction of the cool air into the first and second guide parts may be further disposed on the extension part.

A connection hole communicating with a cool air duct may be defined in the extension part, and the connection hole may be defined in a side of the first guide part.

The first and second guide parts may have different sectional areas through which the cool air flows, and the same flow rate of cool air may be discharged through the first and second guide parts.

A guide rib partitioning the inside of the guide duct to extend toward a front end through which the cool air is discharged, thereby guiding a flow of the cool air may be further disposed inside the guide duct.

In another embodiment, a refrigerator includes: a cabinet defining a refrigerating compartment and a freezing compartment; a heat exchange chamber defined in a side of the cabinet to for receive an evaporator; a storage compartment defined in a side of the cabinet to provide a storage space which is independent from the refrigerating compartment, the freezing compartment, and the heat exchange chamber; a supply duct assembly communicating with the heat exchange chamber, the supply duct assembly being branched into the refrigerating compartment and the storage compartment to supply cool air; a suction duct assembly communicating with the heat exchange chamber in the refrigerating compartment and the storage compartment to recover the cool air into the heat exchange chamber; and guide ducts communicating with the supply duct assembly, the guide ducts extending from a rear surface of the storage compartment up to a front portion of the storage compartment to guide the cool air into the front portion of the storage compartment, wherein the guide ducts are respectively provided on both left and right sides of the storage compartment, and a front discharge hole for discharging the cool air is defined in a front end of each of the guide ducts.

The guide ducts disposed on the left and right sides of the storage compartment may be connected to each other by a connection part, and the connection part may communicate with a side of the supply duct assembly.

The suction duct assembly may include: a refrigerating compartment suction duct connecting the heat exchange chamber to the refrigerating compartment; and a storage compartment suction duct spaced apart from the suction duct to connect the heat exchange chamber to the storage compartment.

The supply duct assembly may include: a supply duct connection part communicating with the heat exchange chamber; a storage compartment-side supply part extending from the supply duct connection part, the storage compartment-side supply part being branched to communicate with the storage compartment; and a refrigerating compartment-side supply part extending from the supply duct connection part, the refrigerating compartment-side supply part being branched to communicate with the refrigerating compartment.

A refrigerating compartment cooling duct communicating with the refrigerating compartment-side supply part to guide the cool air toward the inside of the refrigerating compartment may be further disposed inside the refrigerating compartment.

A damper for adjusting the supply of the cool air into the guide ducts to adjust a temperature within the storage compartment may be further disposed on a side of the storage compartment supply part.

A discharge hole of the storage compartment supply part may be defined in a position corresponding to a side of the guide ducts disposed on both left and right sides of the storage compartment.

The pair of guide ducts may communicate with each other.

The pair of guide ducts may individually communicate with supply duct assembly.

The supply duct assembly may be branched to respectively communicate with the pair of guide ducts.

The details of one or more embodiments are set forth in the accompanying drawings and the description below. Other features will be apparent from the description and drawings, and from the claims.

DETAILED DESCRIPTION OF THE EMBODIMENTS

Hereinafter, exemplary embodiments will be described in detail with reference to the accompanying drawings. The spirit and scope of the present disclosure, however, shall not be construed as being limited to embodiments provided herein. Rather, it will be apparent that other embodiments that fall within the spirit and scope of the present disclosure may easily be derived through adding, modifying, and deleting elements herein.

Figure 1:
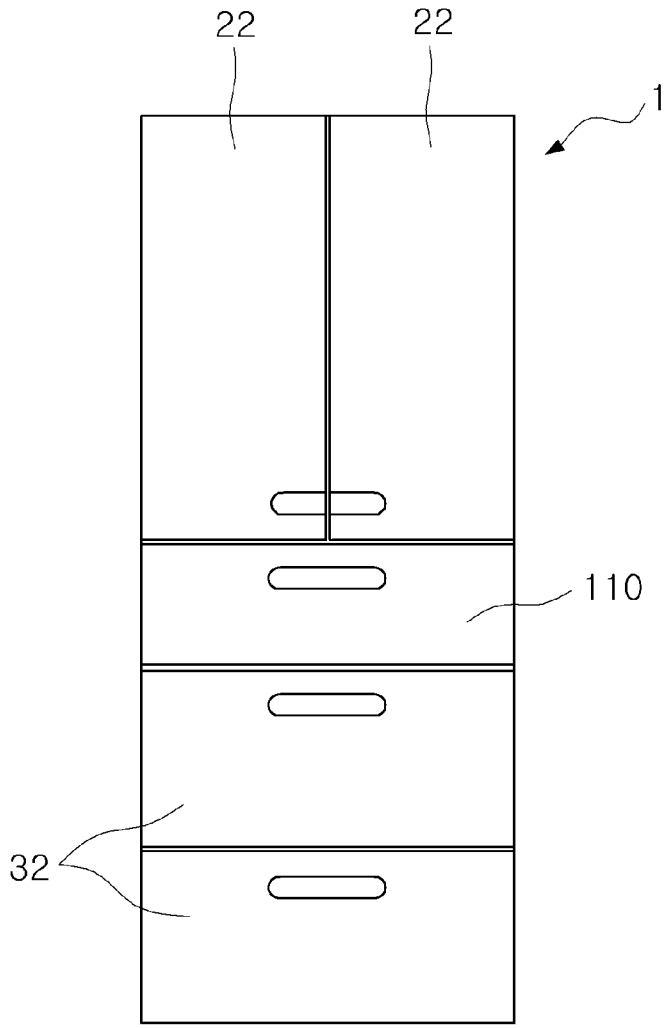
FIG. 1 is a front view of a refrigerator according to an embodiment.
Figure 2:
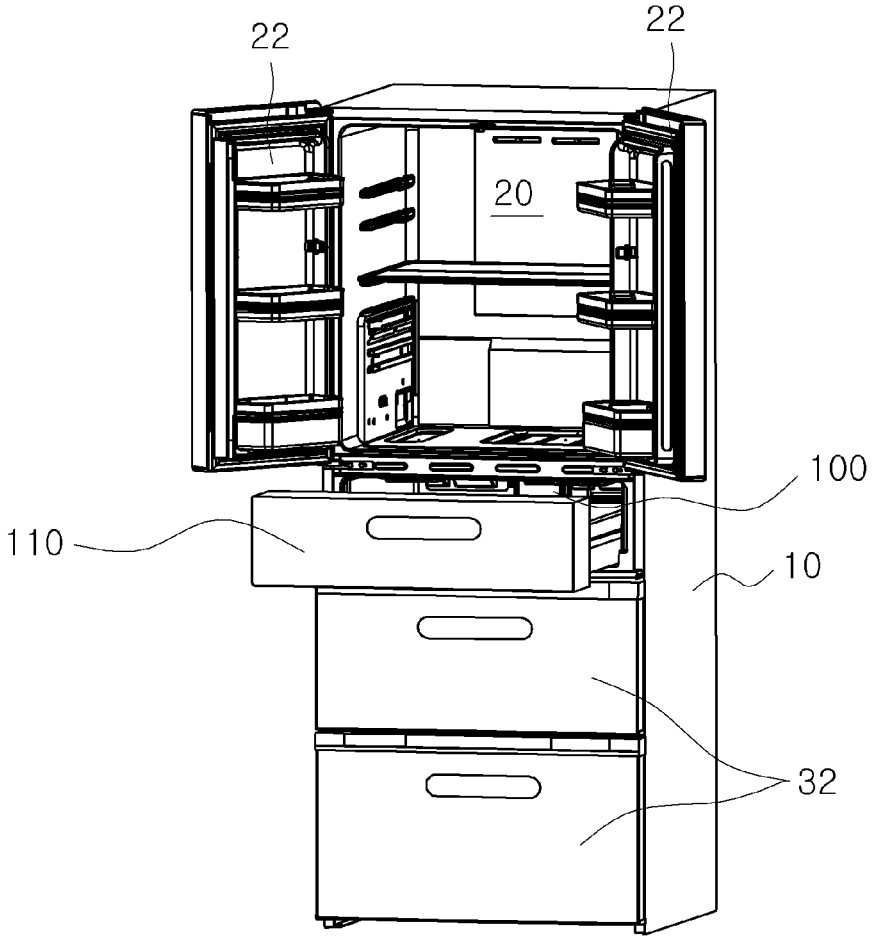
FIG. 2 is a perspective view of the refrigerator with a refrigerating compartment door and storage compartment door opened.

FIG. 1 is a front view of a refrigerator according to an embodiment. FIG. 2 is a perspective view of the refrigerator with a refrigerating compartment door and storage compartment door opened.

Referring to FIGS. 1 to 2, a refrigerator 1 according to an embodiment includes a cabinet 10 and a door. Here, the cabinet 10 and the door define an outer appearance of the refrigerator 1.

The cabinet 10 has a receiving space therein. That is, the cabinet 10 may be vertically partitioned to define a refrigerating compartment 20, a freezing compartment 30, and a storage compartment 100. The refrigerating compartment 20 is defined in an upper side of the cabinet 10, and the storage compartment 100 and the freezing compartment 30 are successively defined below the refrigerating compartment 20.

The refrigerating compartment 20, the storage compartment 100, and the freezing compartment 30 may be partitioned into separate spaces insulated from each other. Also, as needed, the refrigerating compartment 20, the storage compartment 100, and the freezing compartment 30 may be partitioned into a plurality of spaces. A plurality of receiving members for receiving foods may be disposed inside the refrigerating compartment 20, the storage compartment 100, and the freezing compartment 30.

Also, the door opens or closes opened front surfaces of the refrigerating compartment 20, the storage compartment 100, and the freezing compartment 30. The door may include a refrigerating compartment door 22, a storage compartment door 110, and a freezing compartment door 32. The door may be a rotation type door or a drawer type door according to an opening/closing type of each of the refrigerating compartment 20, the storage compartment 100, and the freezing compartment 30.

Also, when the refrigerating compartment 20, the storage compartment 100, and the freezing compartment 30 are partitioned into the plurality of spaces, the door may be provided in numbers corresponding to the number of spaces to respectively open or close the spaces. Alternatively, one door may open or close the plurality of spaces.

For example, the refrigerating compartment door 22 may be disposed on each of both left and right sides to open or close the refrigerating compartment 20 through the rotation thereof. Also, the storage compartment door 110 and the freezing compartment door 32 may slidingly withdraw the storage compartment 100 and the freezing compartment 30 in a drawer type to open or close the storage compartment 100 and the freezing compartment 30, respectively.

Drawer type baskets for receiving may be integrally provided on back surfaces of the storage compartment door 110 and the freezing compartment door 32, respectively. Thus, the baskets may be withdrawn together with the storage compartment door 110 and the freezing compartment door 32 according to an opening/closing of the storage compartment door 110 and the freezing compartment door 32. A separate receiving container may be provided within each of the baskets or inside the storage compartment 100 and the freezing compartment 30.

Figure 3:
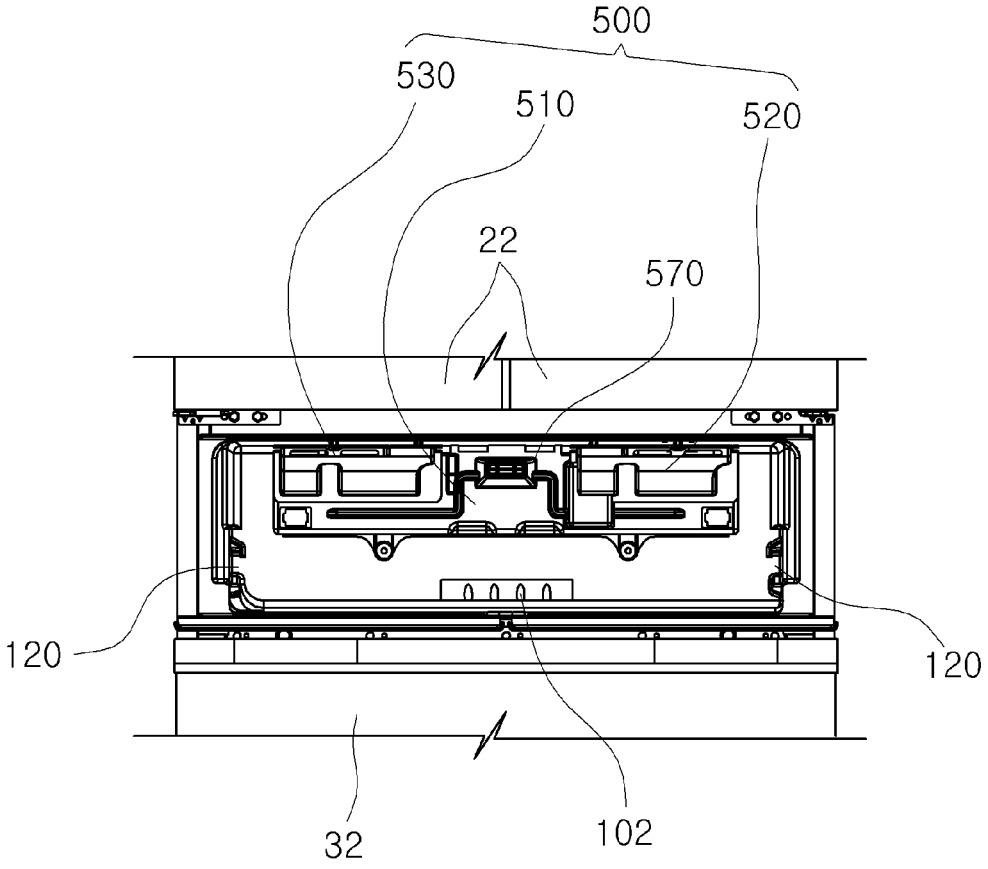
FIG. 3 is a front view illustrating the inside of the storage compartment.

FIG. 3 is a front view illustrating the inside of the storage compartment.

Referring to FIG. 3, a front surface of the storage compartment 100 is opened. The refrigerating compartment 20 and the freezing compartment 30 are defined above/below the storage compartment 100, respectively.

A guide duct 500 is disposed inside the storage compartment 100. The guide duct 500 may guide cool air supplied from a heat exchange chamber 400 that will be described below to a front portion of the inside of the storage compartment 100.

The guide duct 500 is mounted on rear and top surfaces of the inside of the storage compartment 100 to extend forward from a rear side of the storage compartment 100. A first guide part 520 and a second guide part 530 through which the cool air is discharged are disposed on both left and right sides of the guide duct 500. An extension part 510 connecting the first guide part 520 to the second guide part 530 is disposed on a rear surface of the storage compartment 100.

A temperature sensor 570 is disposed on a center of the extension part 510. The temperature sensor 570 detects an internal temperature of the storage compartment 100. The temperature sensor 570 is connected to a control part to adjust an opening/closing of a damper 540 that will be described below.

Also, a storage compartment outlet 104 is defined in a lower end of the rear surface. The storage compartment outlet 104 is connected to a storage compartment suction duct 330 that will be described below. Also, the cool air within the storage compartment 100 may be suctioned into the heat exchange chamber through the storage compartment outlet 104.

A rail mounting part 120 on which a rail member for guiding the slidable withdrawal of the storage compartment door 110 is mounted may be further disposed on each of both left and right surfaces of the storage compartment 100.

Figure 4:
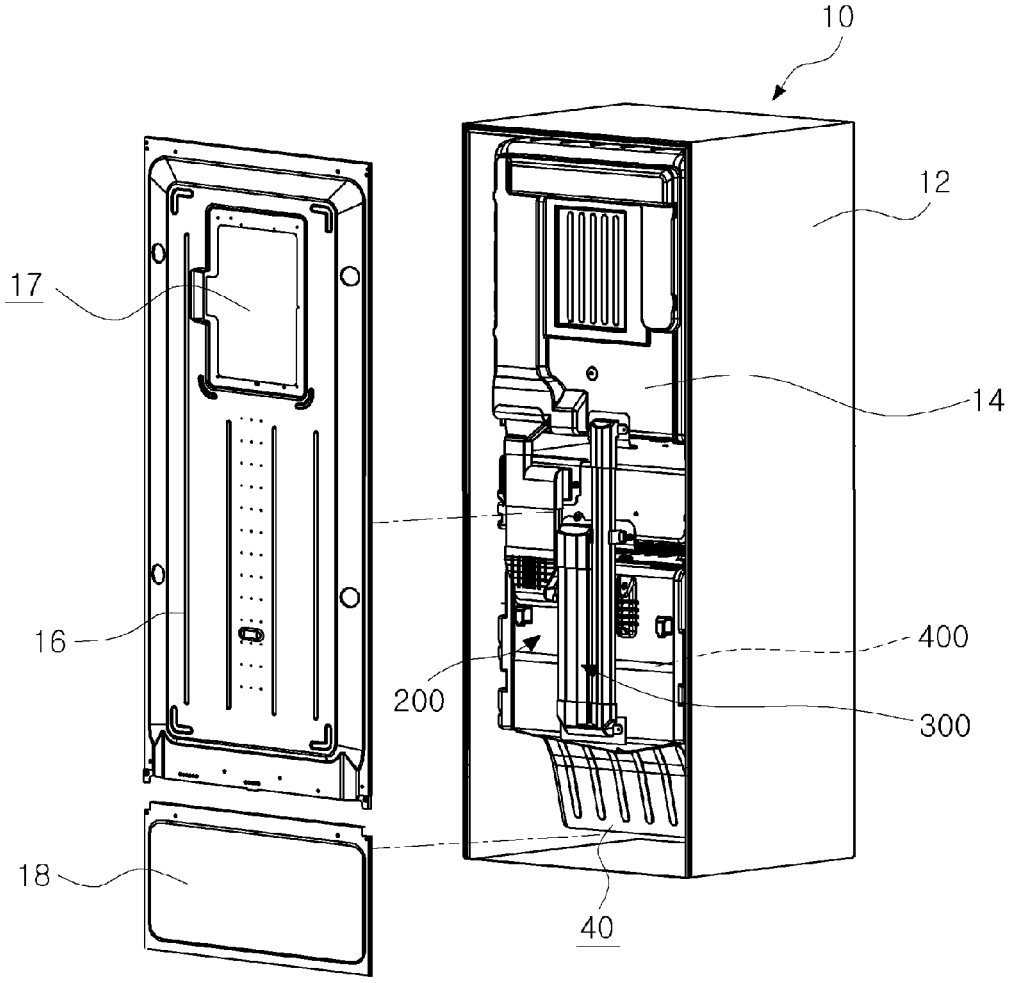
FIG. 4 is an exploded perspective view of the refrigerator with a back surface cover opened.
Figure 5:
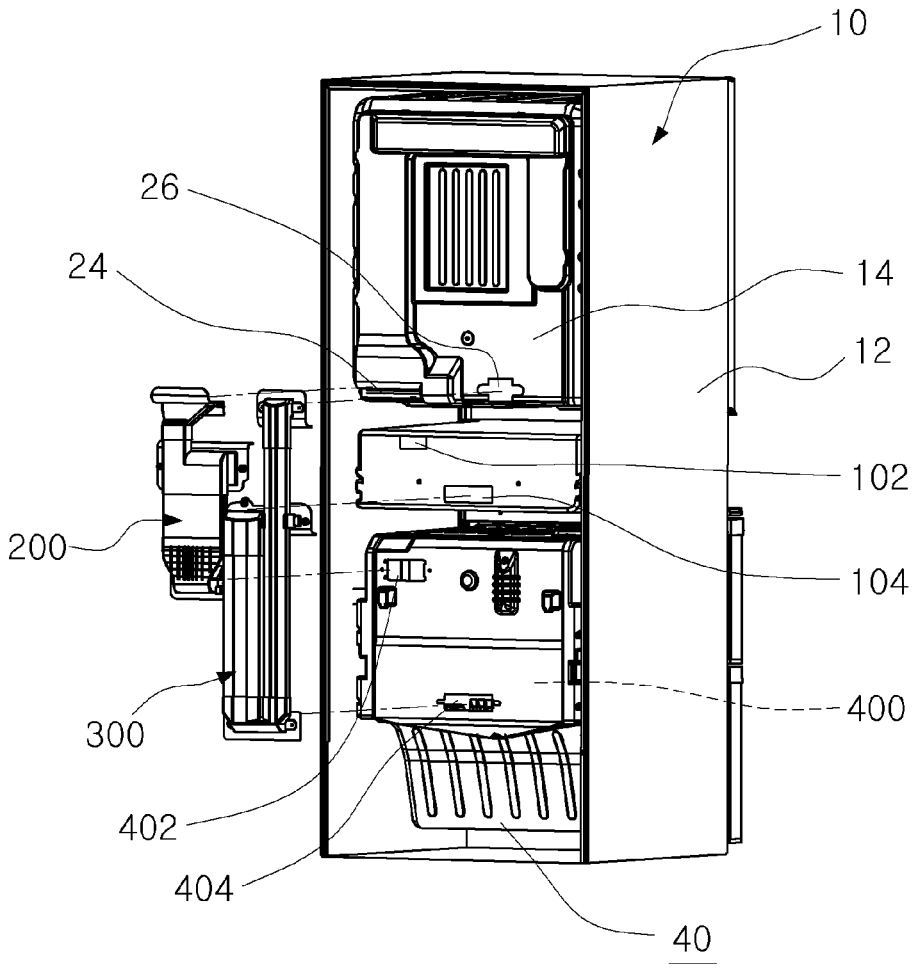
FIG. 5 is an exploded perspective view illustrating a coupled state between a supply duct assembly and a suction duct assembly according to an embodiment.

FIG. 4 is an exploded perspective view of the refrigerator with a back surface cover opened. FIG. 5 is an exploded perspective view illustrating a coupled state between a supply duct assembly and a suction duct assembly according to an embodiment.

Referring to FIGS. 4 and 5, the cabinet 10 includes an outer case 12 defining an outer appearance of the cabinet 10 and an inner case 14 disposed inside the outer case 12. The inner case 14 defines the refrigerating compartment 20, the storage compartment 100, and the freezing compartment 30. A foam insulation material is filled between the outer case 12 and the inner case 14.

The inner case 14 defines the heat exchange chamber 400 including an evaporator 410 for generating cool air. The heat exchange chamber 400 is defined in a rear side of the freezing compartment 30. Also, the heat exchange chamber 400 may be partitioned from the freezing compartment 30 by a grill pan 420 that will be described below.

A back surface of the cabinet 10 is defined by a cabinet cover 16 and a machinery chamber cover 18. The machinery chamber cover 18 covers a machinery chamber 40 defined in a lower side of the cabinet 10. The cabinet cover 16 may cover remaining portions of the back surface of the cabinet 10 except the portion covered by the machinery chamber cover 18.

An opened mounting hole 17 in which a printed circuit board (PCB) is mounted is defined in the cabinet cover 16. The PCB includes a control part for controlling operations of the refrigerator 1 and electric components constituting the refrigerator 1. Also, the PCB may be exposed through the mounting hole 17.

A supply duct assembly 200 and a suction duct assembly 300 for circulating cool air between the heat exchange chamber 400 and the refrigerating compartment 20 and between the heat exchange chamber 400 and the storage compartment 100 are disposed between the inner case 14 and the cabinet cover 16. The supply duct assembly 200 and the suction duct assembly 300 are disposed in rear sides of the refrigerating compartment 20, the storage compartment, and the heat exchange chamber 400. Also, the supply duct assembly 200 and the suction duct assembly 300 are buried into the insulation material filled inside the cabinet 10.

The supply duct assembly 200 and the suction duct assembly 300 may be separately disposed with respect to each other. Also, the suction duct assembly 300 is disposed at a center in a horizontal direction of the inner case 14, and the supply duct assembly 200 may be disposed on a side of the suction duct assembly 300.

Figure 6:
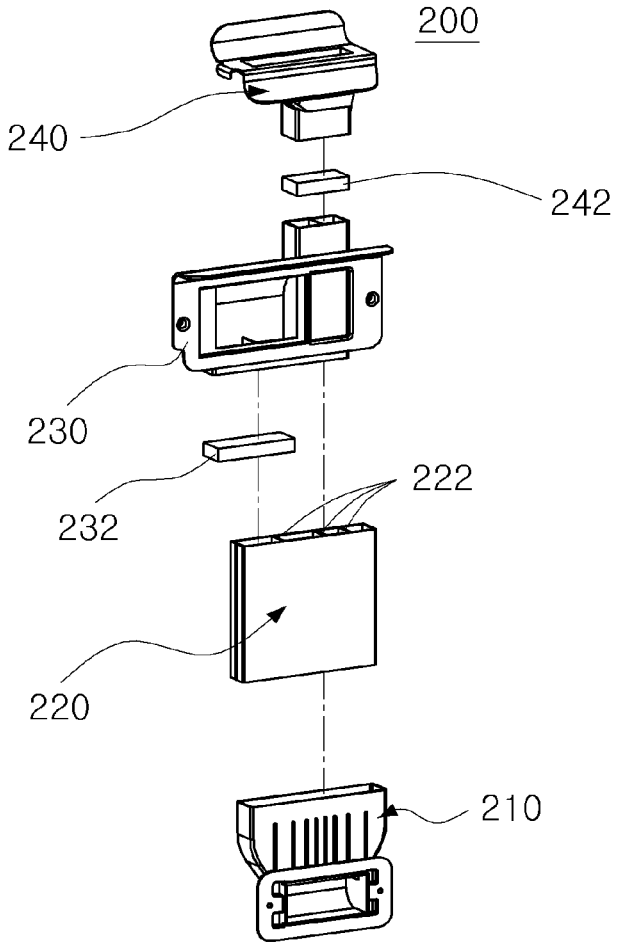
FIG. 6 is an exploded perspective view illustrating a structure of the supply duct assembly.

FIG. 6 is an exploded perspective view illustrating a structure of the supply duct assembly.

The supply duct assembly 200 will be described in detail with reference to FIGS. 5 and 6. The supply duct assembly 200 connects a heat exchange chamber inlet 402 to a refrigerating compartment inlet 24 and a storage compartment inlet 102. Thus, the cool air within the heat exchange chamber 400 may be guided into the refrigerating compartment 20 and the storage compartment 100 through the supply duct assembly 200.

In detail, the supply duct assembly 200 includes a supply duct connection part 210, a supply passage part 220, a refrigerating compartment-side supply part 240, and a storage compartment-side supply part 230.

The supply duct connection part 210 is fixedly mounted on a back surface of the heat exchange chamber 400 to communicate with the heat exchange chamber inlet 402. Also, the supply passage part 220 is disposed on the supply duct connection part 210.

The inside of the supply passage part 220 is partitioned by a plurality of partition plates 222 so that the inside of the supply passage part 220 is branched. Thus, the cool air flowing along the supply passage part 220 may be independently supplied into the refrigerating compartment-side supply part 240 and the storage compartment-side supply part 230. Also, the partition plates 222 may be provided in plurality to prevent the supply passage part 220 from being deformed when the insulation material is foamed.

Also, the storage compartment-side supply part 230 is mounted on an upper end of the supply passage part 220. The storage compartment-side supply part 230 is fixedly mounted on the back surface of the storage compartment 100. The storage compartment-side supply part 230 communicates with the storage compartment inlet 102. The storage compartment-side supply part 230 has a shape corresponding so that the storage compartment-side supply part 230 is seated on the back surface and an edge of a top surface of the storage compartment 100.

The inside of the storage compartment-side supply part 230 may be partitioned. Thus, one portion of the cool air introduced into the storage compartment-side supply part 230 may be supplied into the storage compartment 100, and the other portion of the cool air may be supplied into the refrigerating compartment 20 through the refrigerating compartment-side supply part 240.

Thus, the refrigerating compartment-side supply part 240 is disposed above the storage compartment-side supply part 230. The refrigerating compartment-side supply part 240 communicates with the storage compartment-side supply part 230. Also, an upper end of the refrigerating compartment-side supply part 230 is fixedly mounted on the back surface of the refrigerating compartment 20. The refrigerating compartment-side supply part 240 communicates with a refrigerating compartment-side outlet 26 to supply the cool air within the heat exchange chamber 400 into the refrigerating compartment 20. Also, the upper end of the refrigerating compartment-side supply part 240 has a shape corresponding so that the upper end of the refrigerating compartment-side supply part 240 is closely attached to a rear surface and an edge of a bottom surface of the refrigerating compartment 20.

The storage compartment-side supply part 230 and the refrigerating compartment-side supply part 240 may be provided as one member. In this case, the inside of the one member may be branched to supply cool air into each of the refrigerating compartment 20 and the storage compartment 100.

Dampers 232 and 242 may be disposed on the storage compartment-side supply part 230 and the refrigerating compartment-side supply part 240, respectively. Thus, the dampers 232 and 242 may be opened or closed by manipulation or set-up of a user. The dampers 232 and 242 may be opened or closed to adjust a flow rate of cool air, thereby adjusting the cooling of the storage compartment 100 and the refrigerating compartment 20.

Figure 7:
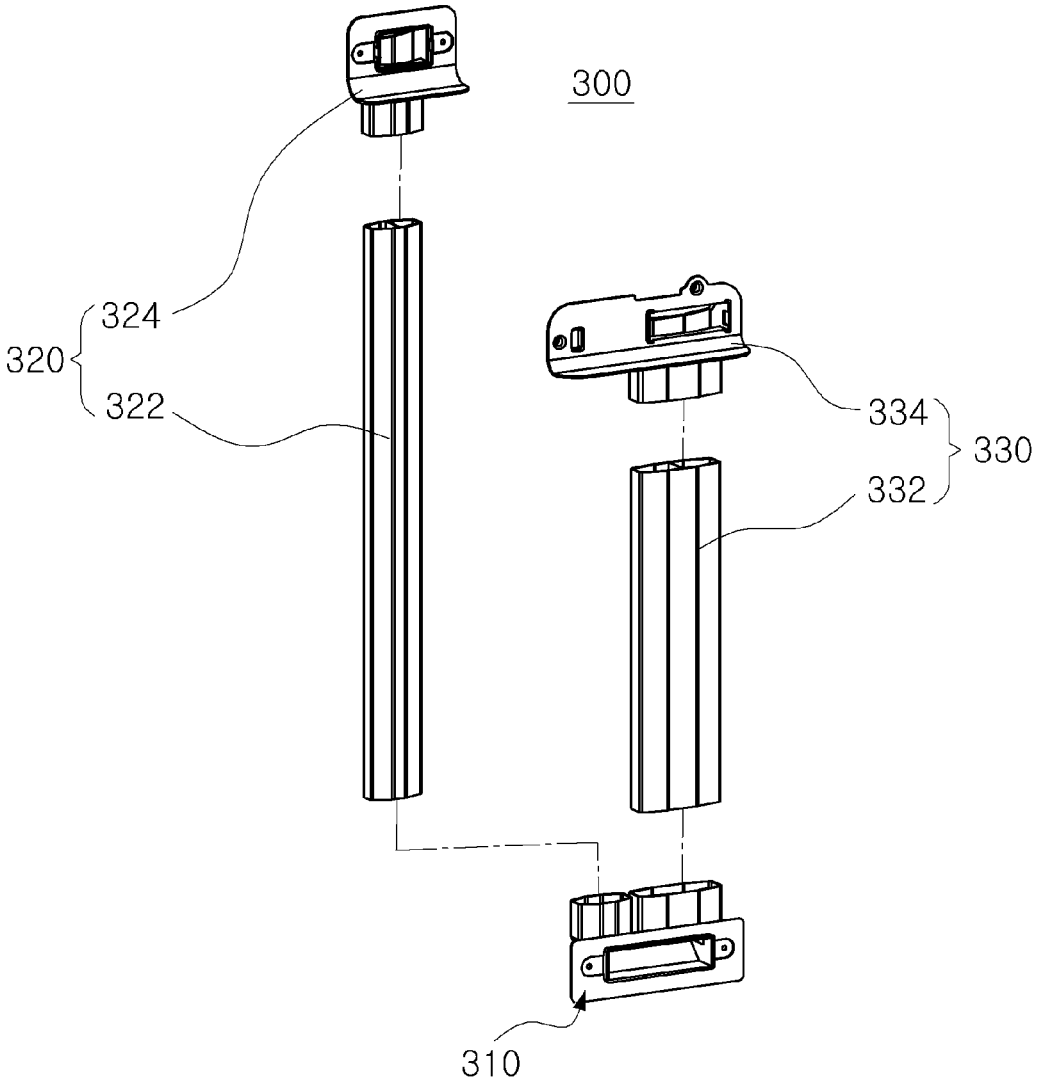
FIG. 7 is an exploded perspective view illustrating a structure of the suction duct assembly.

FIG. 7 is an exploded perspective view illustrating a structure of the suction duct assembly.

The suction duct assembly 300 will be described in detail with reference to FIGS. 5 and 7. The suction duct assembly connects the refrigerating compartment outlet 26 and the storage compartment outlet 104 to a heat exchange chamber outlet 404. Thus, air within the refrigerating compartment 20 and the storage compartment 100 may be guided into the heat exchange chamber 400 through the suction duct assembly 300.

In detail, the suction duct assembly 300 includes a refrigerating compartment suction duct 320, a storage compartment suction duct 330, and the suction duct connection part 310.

The suction duct connection part 310 is connected to each of lower ends of the refrigerating compartment suction duct 320 and the storage compartment suction duct 330. Also, the suction duct connection part 310 is connected to the heat exchange chamber outlet 404. Thus, cool air introduced from the refrigerating compartment suction duct 320 and the storage compartment suction duct 330 may be guided so that the cool air is supplied into the heat exchange chamber 400.

As needed, the suction duct connection part 310 may be omitted, and thus, the refrigerating compartment suction duct 320 and the storage compartment duct 330 may be directly connected to the heat exchange chamber outlet 404.

The refrigerating compartment suction duct 320 allows the refrigerating compartment 20 and the heat exchange chamber 400 to communicate with each other. Thus, the refrigerating compartment suction duct 320 guides cool air within the refrigerating compartment 20 into the heat exchange chamber 400. The refrigerating compartment suction duct 320 may include a refrigerating compartment passage part 322 and a refrigerating compartment connection part 324.

The refrigerating compartment passage part 322 has a tube shape. The refrigerating compartment passage part 322 may have a lower end connected to the suction duct connection part 310 and an upper end connected to the refrigerating compartment connection part 324. The refrigerating compartment connection part 324 may communicate with the refrigerating compartment inlet and have a shape corresponding so that the refrigerating compartment connection part 324 is seated on the bask surface and an edge of a bottom surface of the refrigerating compartment 20.

The storage compartment suction duct 330 is separately provided on a side of the refrigerating compartment suction duct 320. The storage compartment suction duct 330 communicates with the storage compartment 100 and the heat exchange chamber 400 to guide cool air within the storage compartment 100 into the heat exchange chamber 400. The storage compartment suction duct 330 may include a storage compartment passage part 332 and a storage compartment connection part 334.

The storage compartment passage part 332 has a tube shape. The storage compartment passage part 332 may have a lower end connected to the suction duct connection part 310 and an upper end connected to the storage compartment connection part 334. The storage compartment connection part 334 may communicate with the storage compartment outlet 104 and have a shape corresponding so that the storage compartment connection part 334 is seated on the back surface and an edge of a bottom surface of the storage compartment 100.

Figure 8:
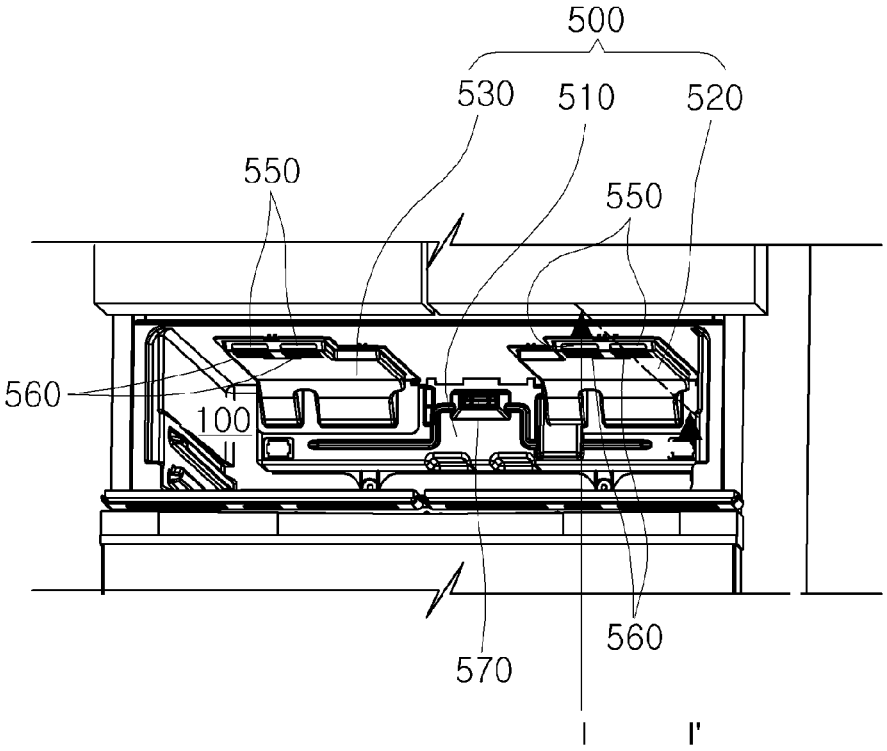
FIG. 8 is a view illustrating a state in which a guide duct is mounted according to an embodiment.
Figure 9:
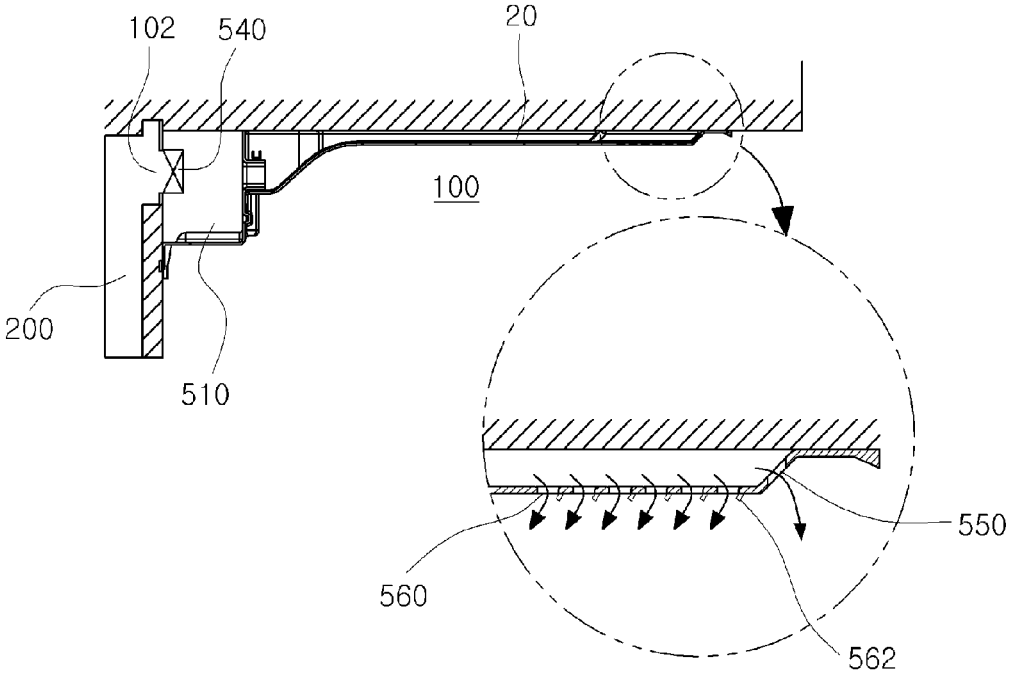
FIG. 9 is a cross-sectional view taken along line I-I' of FIG. 8.
Figure 10:
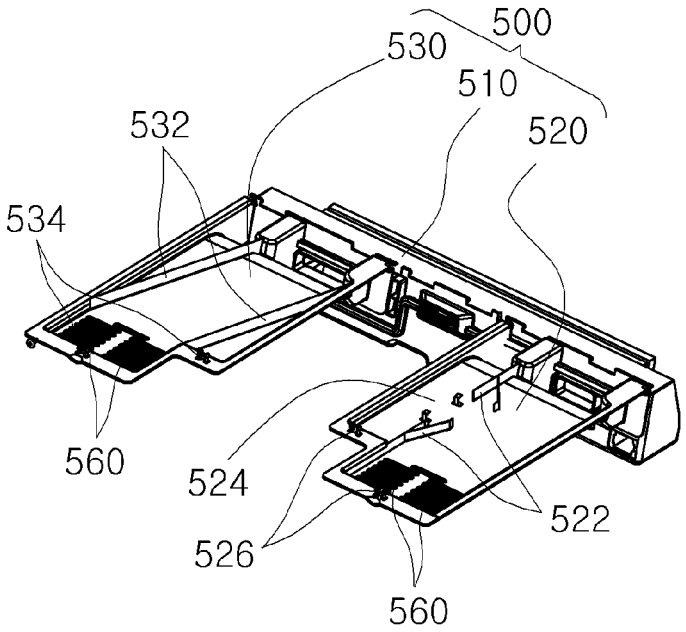
FIG. 10 is a perspective view of the guide duct when viewed from a front side.
Figure 11:
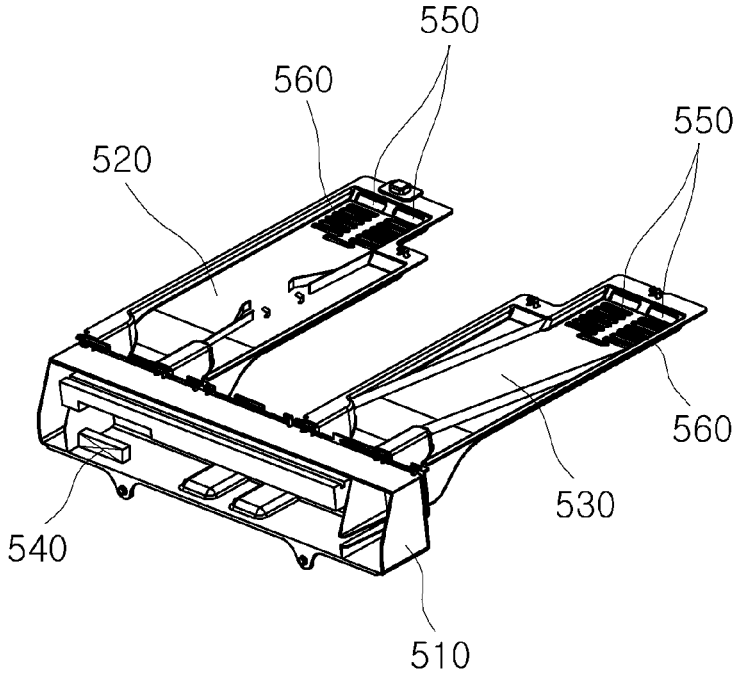
FIG. 11 is a perspective view of the guide duct when viewed from a rear side.

FIG. 8 is a view illustrating a state in which the guide duct is mounted according to an embodiment. FIG. 9 is a cross-sectional view taken along line I-I' of FIG. 8. FIG. 10 is a perspective view of the guide duct when viewed from a front side. FIG. 11 is a perspective view of the guide duct when viewed from a rear side.

Referring to FIGS. 8 to 11, the guide duct 500 is mounted on an inner rear wall and a top surface of the storage compartment 100. The guide duct 500 has a space therein. Thus, when the guide duct 500 is mounted on the storage compartment 100, cool air may flow through the inner space of the guide duct 500. Also, the guide duct 500 may extend from a rear wall of the storage compartment 100 up to a front portion of the storage compartment 100 to guide cool air into the front portion of the storage compartment 100.

The guide duct 500 will be described in detail. The guide duct 500 may include an extension part 510, a first guide part 520, and a second guide part 530.

The extension part 510 is mounted on the rear wall of the storage compartment 100 to lengthily extend in a horizontal direction. Also, the extension part 510 is opened in a rear direction to define a cool air flow passage when the extension part 510 is mounted on the storage compartment 100. Also, the extension part 510 is mounted to communicate with the storage compartment inlet 102. Thus, cool air introduced through the storage compartment inlet 102 may flow along the extension part 510.

The damper 540 may be disposed on the storage compartment inlet 102 or the inside of the guide duct 500. The damper 540 may be opened or closed to adjust a flow rate of cool air introduced into the guide duct 500.

The first guide part 520 and the second guide part 530 are disposed on left and right ends of the extension part 510, respectively. The first guide part 520 and the second guide part 530 guide cool air flowing through the extension part 510 forward. Each of the first guide part 520 and the second guide part 530 has an opened top surface. When the first and second guide parts 520 and 530 are mounted on a top surface of the storage compartment 100, the opened top surface of each of the first and second guide parts 520 and 530 may serve as a cool air flow passage.

The first guide part 520 and the second guide part 530 extend in a front direction of the storage compartment 100. Here, the first guide part 520 and the second guide part 530 may further protrude in the front direction of the storage compartment 100 than a center of the at least storage compartment 100.

The first guide part 520 is disposed at a right side when viewed in FIG. 8. Here, the first guide part 520 may be disposed at a position corresponding to that of the storage compartment inlet 102 so that cool air discharged from the storage compartment inlet 102 flows forward through the first guide part 520.

The second guide part 530 is disposed at a right side when viewed in FIG. 8. Thus, cool air introduced through the storage compartment inlet 102 flows along the extension part 510 and then flows forward along the second guide part 530.

The second guide part 530 has a cool air flow passage longer than that of the first guide part 520. Thus, the second guide part 530 may have an inner sectional area greater than that of the first guide part 520.

A plurality of discharge holes are defined in front portions of the first and second guide parts 520 and 530. Cool air guided by the first and second guide parts 520 and 530 is discharged into the storage compartment 100 through the discharge holes. The discharge holes include front discharge holes 550 and lower discharge holes 560.

The front discharge holes 550 are opened in front ends of the first and second guide parts 520 and 530. The front discharge holes 550 are defined in inclined front surfaces of the first and second guide parts 520 and 530 to discharge the cool air forward. Here, the cool air may be discharged somewhat downward in inclined directions by angles of the inclined front surfaces.

Also, the lower discharge holes 560 are provided in plurality in rear sides of the front discharge holes 550. The lower discharge holes 560 may be disposed in more front sides than centers of the first and second guide parts 520 and 530. Also, the lower discharge holes 560 are provided in plurality with a predetermined distance at a position adjacent to the front discharge holes 550.

Thus, the cool air induced into the front portion of the storage compartment 100 through the first and second guide parts 520 and 530 may be supplied into the front portion of the storage compartment 100 by the front discharge holes 550 and the lower discharge holes 560. The front discharge holes 550 and the lower discharge holes 560 may be lengthily defined in a horizontal direction and arranged in tow rows.

Also, opened areas of the plurality of lower discharge holes 560 may correspond to inner sectional areas of the first and second guide parts 520 and 530 to prevent a pressure of the cool air flowing along the first and second guide parts 520 and 530 from dropping down due to the lower discharge holes 560. Thus, a constant flow rate of cool air may be discharged through the front discharge holes 550 and the lower discharge holes 560.

The front discharge holes 550 and the lower discharge holes 560 may be slightly inclined to allow the discharged cool air to have directivity. Also, as needed, a discharge guide part 562 having a rib shape may be further disposed around each of the front discharge holes 550 and the lower discharge holes 560.

Thus, the cool air discharged through the front discharge holes 550 and the lower discharge holes 560 may be inclinedly discharged forward. Also, the cool air discharged from the lower discharge holes 560 may be discharged laterally.

The discharged directions of the cool air may be set to various directions such as the front direction, the inclined rear direction, and the lateral direction according to inclinations of the front and lower discharge holes 550 and 560 and a direction of the discharge guide part 562.

A first guide rib 522 is disposed in the first guide part 520. The first guide rib 522 extends from a rear end of the first guide part 520 toward the front discharge hole 550. Also, the first guide rib 522 extends parallel to a side surface of the first guide part 520. The first guide rib 552 partitions the inside of the first guide part 520 to guide cool air discharged from the storage compartment inlet 102 toward the front discharge holes 550 and the lower discharge holes 560. Also, the first guide rib 522 is finished at an approximately central portion of the first guide part 520 and an end of the first guide rib 522 is branched to define a deodorizer mounting part 524. Thus, a deodorizer for removing smell within the storage compartment 100 may be mounted on the deodorizer mounting part 524.

A second guide rib 532 is disposed on the second guide part 530. The second guide rib 532 extends from a rear end of the second guide part 530 toward the front and lower discharge holes 550 and 560. Here, the second guide rib 532 may be inclined to guide cool air guided through the extension part 510 toward the front and lower discharge holes 550 and 560.

A sectional area of a passage defined by the second guide rib 532 may be greater than of a passage defined by the first guide rib 522 to secure a stable discharge flow rate of cool air.

Also, a plurality of coupling members 526 and 534, each having a hook shape, are disposed on the first guide part 520 and the second guide part 530. Thus, the first guide part 520 and the second guide part 530 may be fixedly mounted on the top surface of the storage compartment 100 by fitting the coupling members 526 and 534.

Alternatively, the first and second guide parts 520 and the 530 and the extension part 510 may be coupled to each other by a separate coupling member such as a screw or engaged with each other.

Also, the guide duct 500 may not protrude from the top surface of the storage compartment 100, but be inserted into the top surface of the storage compartment 100. In this case, only the first and lower discharge holes 550 and 560 may be exposed to the outside. Here, an outer surface of the guide duct 500 may be flush with the top surface of the storage compartment 100 on the whole.

Hereinafter, the refrigerator including the above-described components according to an embodiment will be described with reference to the accompanying drawings.

Figure 12:
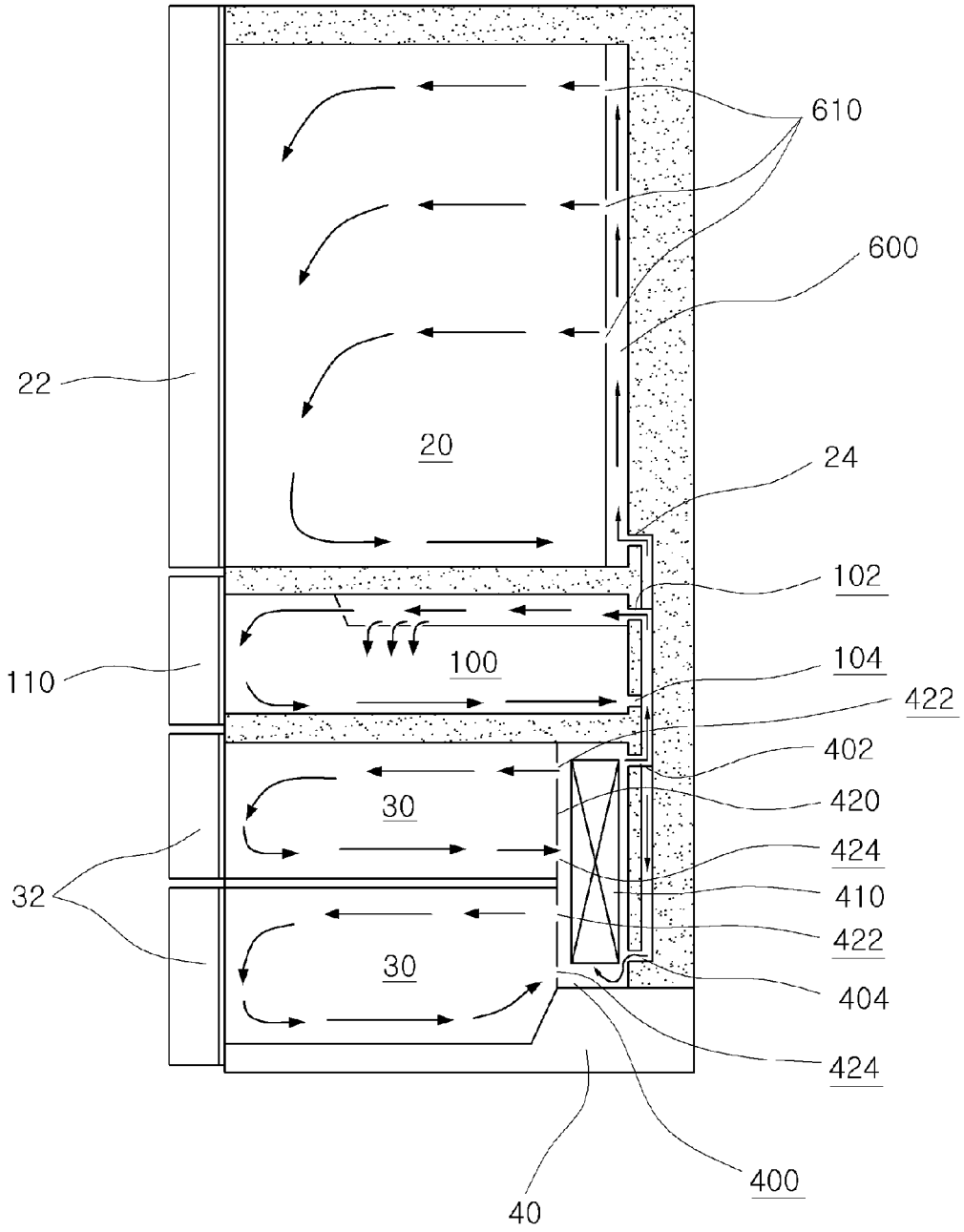
FIGS. 12 and 13 are schematic views illustrating an overall cool air circulation state within the refrigerator.
Figure 13:
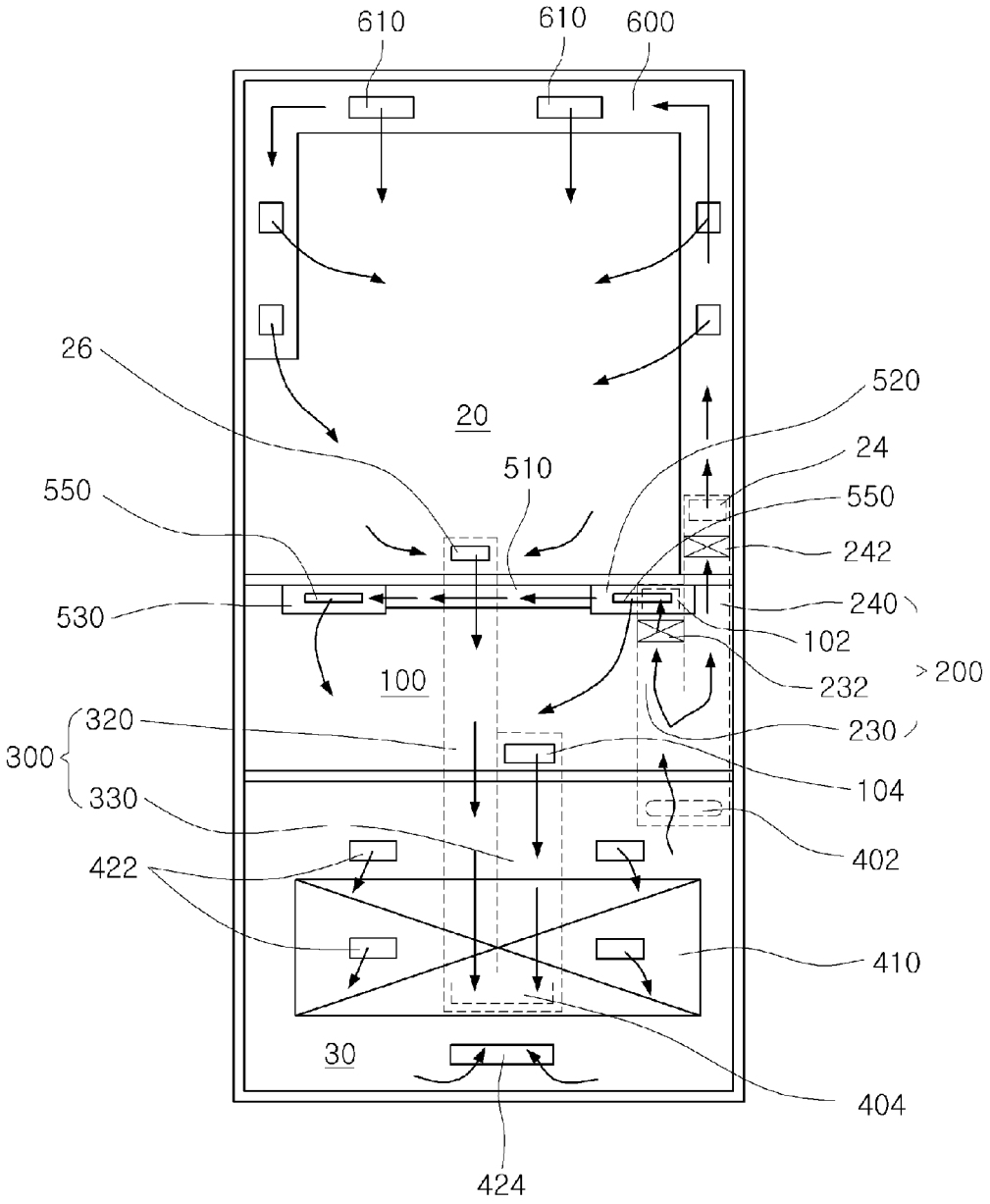

FIGS. 12 and 13 are schematic views an overall cool air circulation state within the refrigerator.

Referring to FIGS. 12 and 13, when the refrigerator 1 is operated, cool air is generated in the evaporator 410 by driving a cooling cycle of the refrigerator 1. The generated cool air is circulated and supplied into the refrigerating compartment 20, the storage compartment 100, and the freezing compartment 30 to cool the inside of the refrigerator 1.

In detail, approximately 50% of cool air generated in the evaporator 410 may be supplied into the freezing compartment 30 through the grill 420 partitioning the freezing compartment 30 from the heat exchange chamber 400. For this, a freezing compartment outlet 424 and a freezing compartment inlet 422 are defined in the grill pan 420. Also, when the freezing compartment 30 is partitioned in a plurality of spaces, the freezing compartment outlet 424 and the freezing compartment inlet 422 may be defined in positions corresponding to the plurality of spaces, respectively. Thus, the freezing compartment 30 may be cooled by circulating the cool air between the freezing compartment 30 and the heat exchange chamber 400.

The refrigerating compartment 20 is connected to the heat exchange chamber 400 by the supply duct assembly 200 and the suction duct assembly 300. Thus, the inside of the refrigerating compartment 20 is cooled by circulating the cool air between the refrigerating compartment and the heat exchange chamber 400. Here, approximately 40% of cool air discharged from the heat exchange chamber 400 may be supplied into the refrigerating compartment 20 to cool the refrigerating compartment 20.

In detail, the cool air within the heat exchange chamber 400 is introduced into the supply duct connection part 210 through the heat exchange chamber inlet 402. Also, the cool air introduced into the supply duct connection part 210 successively passes through the supply duct connection part 210, the supply passage part 220, and the refrigerating compartment-side supply part 240. The cool air guided through the refrigerating compartment-side supply part 240 may be introduced into the refrigerating compartment 20 through the refrigerating compartment inlet 24.

The inside of the supply passage part 220 is branched, and the cool air supplied into the refrigerating compartment 20 is introduced into the refrigerating compartment-side supply part 240. Here, the damper 232 may be disposed on the refrigerating compartment-side supply part 240. The damper 232 may be opened or closed to adjust a flow rate of cool air.

The cool air introduced into the refrigerating compartment inlet 24 is introduced into a refrigerating compartment cooling duct 600 disposed within the refrigerating compartment 20. The refrigerating compartment cooling duct 600 may communicates with the supply duct assembly 200 and be disposed in an inner rear wall of the refrigerating compartment 20. The refrigerating compartment cooling duct 600 is disposed along a circumference of the refrigerating compartment 20 to discharge cool air into the refrigerating compartment 20 through a plurality of cool air holes 610.

Air heat-exchanged within the refrigerating compartment 20 is discharged into the heat exchange chamber 400 through the suction duct assembly 300. In detail, air within the refrigerating compartment 20 may be introduced into the refrigerating compartment suction duct 320 through the refrigerating compartment outlet 26. Then, the air passes through the suction duct connection part 310 and is introduced into the heat exchange chamber 400 through the heat exchange chamber outlet 404. The above-described circulation process may be performed to cool the refrigerating compartment 20.

The storage compartment 100 may receive cool air from the heat exchange chamber 400 by the supply duct assembly 200. Here, approximately 10% of cool air discharged from the heat exchange chamber 400 may be supplied into the storage compartment 100. That is, when compared with those of the refrigerating compartment 20 and the freezing compartment 30, a relatively less amount of cool air may be discharged. As needed, cool air may be concentratedly supplied into the storage compartment 100 by a separate fan, or the storage compartment 100 may be quickly cooled by the separate fan.

Figure 14:
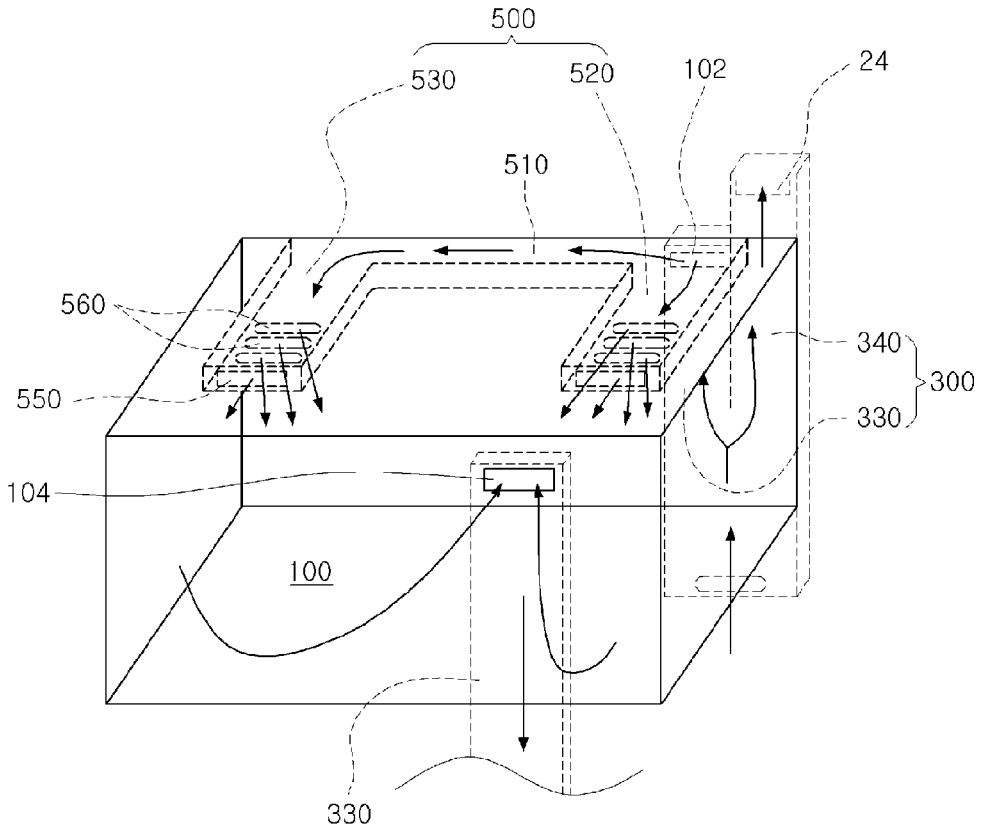
FIG. 14 is a schematic view illustrating a cool air circulation state within the storage compartment.

FIG. 14 is a schematic view illustrating a cool air circulation state within the storage compartment.

A cool air circulation state within the storage compartment will be described with reference to FIGS. 12 to 14.

Cool air generated in the heat exchange chamber 400 is introduced into the supply duct connection part 210 through the heat exchange chamber inlet 402. The cool air introduced into the supply duct connection part 210 is branched in the supply passage part 220 to flow into the storage compartment-side supply part 230. The cool air flowing into the storage compartment-side supply part 230 is introduced into the storage compartment 100 through the storage compartment inlet 102.

The storage compartment inlet 102 is connected to the guide duct 500. Thus, the cool air introduced into the storage compartment inlet 102 is introduced into the guide duct 500. The cool air introduced into the guide duct 500 is branched in the extension part 510 to flow into the first and second guide parts 520 and 530.

Here, the first and second guide parts 520 and 530 may have different passage sectional areas. Thus, even though flow passages of cool air are different in length, discharged amount of cool air discharged through the first and second guide parts 520 and 530 may be uniform.

That is, since the first guide part 520 is disposed at a front side corresponding to the storage compartment inlet 102, the cool air may be directly introduced. Also, the cool air introduced into the first guide part 520 is guided by the first guide rib 522 to flow into the front and lower discharge holes 550 and 560.

Since the second guide part 530 is disposed in a direction facing the first guide part 520, the cool air is moved along the extension part 510 in an opposite direction, and then is introduced into the second guide part 530. The cool air introduced into the second guide part 530 is guided by the second guide rib 532 to flow into the front and lower discharge holes 550 and 560. Since the second guide rib 532 inclinedly extends, the cool air may be supplied at the shortest distance toward the front and lower discharge holes 550 and 560.

The cool air introduced into the first and second guide parts 520 and 530 is discharged from the front portion of the storage compartment 100 toward the front and lower discharge holes 550 and 560. Here, the cool air discharged into the front discharge holes 550 may be inclinedly discharged somewhat downward by the inclinations of the front discharge holes 550. Also, the cool air discharged into the lower discharge holes 560 is discharged downward through the plurality of lower discharge holes 560. The cool air discharged through the lower discharge holes 560 by the discharge guide part 562 may be discharged onto left and right walls of the storage compartment 100.

Since the first and second guide parts 520 and 530 are disposed on left and right sides of the storage compartment 100, respectively, the cool air may be discharged onto left and right sides of the front portion of the storage compartment 100. Thus, the front portion and left and right surfaces of the storage compartment 100 which have relatively high temperatures may be cooled.

Air within the storage compartment 100 is introduced into the storage compartment suction duct 330 through the storage compartment outlet 104 defined in a lower side of the inner rear wall of the storage compartment 100. Since the storage suction duct 330 is separately provided with respect to the refrigerating compartment suction duct 320, the air flows up to the heat exchange chamber 400 without being mixed, and then, the air within the storage compartment 100 is introduced through the heat exchange chamber outlet 404. Thus, the cool air within the storage compartment 100 and the heat exchange chamber 400 may be continuously circulated to cool the inside of the storage compartment 100.

The refrigerating compartment suction duct 320 and the storage compartment suction duct 330 have separate passages, respectively, cool air suctioned from the refrigerating compartment 20 and the storage compartment 100 is not mixed with each other to prevent the inside of the duct from being frozen.

The damper 540 may be disposed on a side of the guide duct 500 connected to the storage compartment inlet 102. The damper 540 may adjust a flow rate of cool air introduced into the guide duct 500. Thus, the damper 540 may be opened or closed to adjust the introduction of the cool air and a temperature of the storage compartment 100.

The damper 540 is electrically connected to the temperature sensor 570 by the control part. If a temperature condition of the temperature sensor 570 is not satisfied, the damper 540 may be opened to supply cool air into the storage compartment 100.

The guide duct 500 may not be connected by the extension part 510, but be independently provided on each of left and right sides of the top surface of the storage compartment 100. Here, an end of the storage compartment-side supply part 230 is branched, and thus the branched ends may be directly connected to rear ends of the first and second guide parts 520 and 530, respectively.

According to the proposed embodiment, the cool air is supplied into the storage compartment by the guide duct. The guide duct extends from the rear surface of the storage compartment to the front portion of the storage compartment to discharge the cool air into a front end of the guide duct.

Thus, the cool air guided from the heat exchange chamber is induced toward a front side of the storage compartment by the guide duct and supplied into the front portion of the storage compartment. Thus, the inner front portion of the storage compartment which has a relatively high temperature may be effectively cooled to realize uniform temperature distribution within the storage compartment.

Also, the guide duct may be disposed on each of both left and right sides of the storage compartment to uniformly supply cool air into both left and right sides within the storage compartment. Thus, the front portion and the left and right surfaces of the storage compartment which have relatively high temperatures may be effectively cooled.

Also, the front discharge hole opened forward and the lower discharge hole opened downward may be defined in the guide duct. Thus, when cool air is discharged, the cool air may be discharged forward and downward at the same time to effectively cool the inside of the storage compartment.

Thus, the cooling efficiency within the storage compartment may be improved, and the inside of the storage compartment may have uniform temperature distribution to improve the storage performance of the storage compartment.

According to the embodiment, a temperature may be uniformly distributed in the whole storage compartment to improve storage performance. Thus, industrial applicability is very high.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising: an inner case including:

a heat exchange chamber defined at a rear inside portion of the inner case;

an evaporator received in the heat exchange chamber;

a freezing compartment disposed in front of the heat exchange chamber;

a grill pan partitioning the freezing compartment and the heat exchange chamber;

a storage compartment defined inside the inner case and disposed above the freezing compartment, the storage compartment being convertibly maintained between a freezing compartment temperature and a refrigerating compartment temperature; and a refrigerating compartment defined inside the inner case and disposed above the storage compartment;

a first supply duct vertically extending at a rear outside of the inner case, the first supply duct being disposed at a side portion of the inner case, for connecting the heat exchange chamber and the storage compartment and supplying cool air in the heat exchange chamber to the storage compartment;

a second supply duct vertically extending at the rear outside of the inner case, the second supply duct being disposed at the side portion of the inner case, for connecting the heat exchange chamber and the refrigerating compartment and supplying cool air in the heat exchange chamber to the refrigerating compartment;

a first return duct disposed vertically extending at the rear outside of the inner case and substantially at a central portion of a rear surface of the inner case, for connecting the storage compartment and the heat exchange chamber and returning the cool air in the storage compartment to the heat exchange chamber;

a second return duct disposed vertically extending at the rear outside of the inner case and substantially at the central portion of the rear surface of the inner case, for connecting the refrigerating compartment and the heat exchange chamber and returning the cool air in the refrigerating compartment to the neat exchange chamber; and a guide duct disposed in the storage compartment and communicating with an outlet of the first supply duct, the guide duct including:

an extension part extending in a left-to-right direction of the storage compartment and attached to a rear inner wall of the storage compartment to communicate with the outlet of the first supply duct through a storage compartment inlet formed in the rear surface of the inner case;

a first guide part disposed at an upper inner wall of the storage compartment and extending forward from a first side end of the extension part to guide the cool air supplied through the first supply duct forward in the storage compartment; and a second guide part disposed at the upper inner wall of the storage compartment and extending forward from a second side end of the extension part to guide the cool air supplied through the first supply duct forward in the storage compartment, wherein the first supply duct and the second supply duct are provided side by side as one member.

2. The refrigerator of claim 1, wherein the first guide part includes:

a first guide rib extending from a rear end of the first guide part toward a front end of the first guide part, the first guide rib being disconnected at a position thereof to provide disconnected portions, wherein each of the disconnected portions of the first guide rib has a branched part; and a deodorizer mounting part defined by the branched parts of the disconnected portions of the first guide part.

3. The refrigerator of claim 1, further comprising a temperature sensor, wherein the temperature sensor is mounted on a front surface of the extension part between the first and second guide parts.

4. The refrigerator of claim 1, wherein each of the first and second guide parts includes:

a front discharge hole defined in a front surface of a front end thereof, to discharge the cool air forward; and a plurality of lower discharge holes defined in a bottom surface thereof, to discharge the cool air downwards.

5. The refrigerator of claim 1, wherein at least a portion of the upper wall of the storage compartment is recessed in a shape corresponding to a shape of the first and second guide parts, such that, when the first and second guide parts are attached to the upper wall of the storage compartment, lower surfaces of the first and second guide parts are coplanar to the upper wall.

6. The refrigerator of claim 1, further comprising dampers respectively disposed at the outlet of the first supply duct and an outlet of the second supply duct, to control an amount of the cool air supplied to the storage compartment and the refrigerating compartment, respectively.

7. The refrigerator of claim 1, wherein the outlet of the first supply duct is closer to the first guide part than the second guide part, and wherein a vertically wherein an inner sectional area of the second guide part is greater than that of the first guide part.

8. The refrigerator of claim 1, further comprising a refrigerating compartment cooling duct communicating with an outlet of the second supply duct through a refrigerating compartment inlet formed in the rear surface of the inner case, wherein the refrigerating compartment cooling duct extends along a circumference of the refrigerating compartment and having a plurality of cool air holes to uniformly supply the cool air supplied through the second supply duct into the refrigerating compartment.

9. The refrigerator of claim 8, wherein the refrigerating compartment cooling duct extends sequentially along a first side edge, an upper side, and at least a portion of a second side edge of the refrigerating compartment.

10. The refrigerator of claim 1, wherein the first and second supply ducts are provided in a shape of a single module, and share a single inlet which is used to suction the cool air in the heat exchange chamber.

11. The refrigerator of claim 1, wherein the first and second return ducts are provided in a shape of a single module, and share a single outlet which is used to discharge the cool air to the heat exchange chamber.

* * * * *